US009227290B2

(12) United States Patent
Clabunde

(10) Patent No.: US 9,227,290 B2
(45) Date of Patent: Jan. 5, 2016

(54) POWER-DRIVEN HAND TOOL

(75) Inventor: Joachim Clabunde, Heubach (DE)

(73) Assignee: C. & E. FEIN GMBH (DE)

( * ) Notice: Subject to any disclaimer, the term of this patent is extended or adjusted under 35 U.S.C. 154(b) by 639 days.

(21) Appl. No.: 13/570,483

(22) Filed: Aug. 9, 2012

(65) Prior Publication Data

US 2013/0037290 A1 Feb. 14, 2013

(30) Foreign Application Priority Data

Aug. 9, 2011 (EP) ..... 11176980

(51) Int. Cl.

| | |
|---|---|
| ***E21B 3/00*** | (2006.01) |
| ***E21B 17/22*** | (2006.01) |
| ***E21B 19/16*** | (2006.01) |
| ***E21B 19/18*** | (2006.01) |
| ***B24B 23/04*** | (2006.01) |
| ***B25F 5/00*** | (2006.01) |

(52) U.S. Cl.

CPC ..... *B24B 23/04* (2013.01); *B25F 5/006* (2013.01)

(58) Field of Classification Search

CPC .... B24B 23/04; B24B 41/007; B24B 41/042; B27B 19/006; B27B 5/32; B25F 5/00; B25F 3/00

USPC ..... 173/162.1, 213–217

See application file for complete search history.

(56) References Cited

U.S. PATENT DOCUMENTS

| | | | | |
|---|---|---|---|---|
| 4,242,839 | A * | 1/1981 | Armbruster | B24B 23/04 451/357 |
| 5,967,243 | A | 10/1999 | Jacobsson | |
| 8,162,727 | B2 | 4/2012 | Zaiser | |
| 2004/0082283 | A1 | 4/2004 | Lindell et al. | |
| 2009/0311952 | A1 | 12/2009 | Zaiser | |
| 2009/0320625 | A1 * | 12/2009 | Kildevaeld | 74/25 |
| 2010/0000749 | A1 * | 1/2010 | Andel | 173/48 |
| 2010/0025061 | A1 * | 2/2010 | Meixner et al. | 173/118 |
| 2010/0300715 | A1 * | 12/2010 | Storm et al. | 173/90 |
| 2011/0017483 | A1 * | 1/2011 | Baumann et al. | 173/162.2 |
| 2011/0036609 | A1 * | 2/2011 | Blickle et al. | 173/213 |
| 2011/0315413 | A1 * | 12/2011 | Fisher et al. | 173/1 |
| 2012/0067607 | A1 * | 3/2012 | Weber | B24B 23/04 173/216 |
| 2014/0020918 | A1 * | 1/2014 | Klabunde | B23D 47/12 173/49 |
| 2014/0182873 | A1 * | 7/2014 | Fankhauser et al. | 173/213 |

FOREIGN PATENT DOCUMENTS

| | | | |
|---|---|---|---|
| CN | 1666036 | A | 9/2005 |
| CN | 1754653 | A | 4/2006 |
| CN | 101412213 | A | 4/2009 |
| CN | 201511357 | U | 6/2010 |
| CN | 201677305 | U | 12/2010 |
| DE | 102007018466 | A1 | 10/2008 |
| GB | 2419558 | A | 5/2006 |
| WO | 2008128804 | A1 | 10/2008 |

* cited by examiner

*Primary Examiner* — Robert Long

(74) *Attorney, Agent, or Firm* — St. Onge Steward Johnston & Reens, LLC

(57) ABSTRACT

A power-driven hand tool is disclosed, comprising a tool spindle that can be driven in a rotational oscillatory manner about its longitudinal axis and that is designed to carry a tool, and further comprising a transmission housing, in which there is carried an eccentric coupling drive for driving the tool spindle and from which the tool spindle projects outwardly with one end, wherein, for the purpose of mass compensation of the oscillatory motion of the eccentric coupling drive, a compensatory mass is provided, which is disposed outside of the transmission housing.

18 Claims, 4 Drawing Sheets

POWER-DRIVEN HAND TOOL

CROSSREFERENCES TO RELATED APPLICATIONS

This application claims priority of European Patent Application no. 11 176 980.8 filed on Aug. 9, 2011, the entire contents of which is fully incorporated herein by reference.

BACKGROUND OF THE INVENTION

The invention relates to a power-driven hand tool, comprising a tool spindle that can be driven in a rotational oscillatory manner about its longitudinal axis and that is designed to carry a tool, and comprising a transmission housing, in which there is carried an eccentric coupling drive for driving the tool spindle and from which the tool spindle projects outwardly with one end.

Such a hand tool is known from WO 2008/128804 A1. The tool in that case is a power tool having a drive unit, for driving a drive shaft, and having an output shaft, on which a tool is carried. The rotary motion of the drive shaft can be transferred to the output shaft via an eccentric coupling device.

Such hand tools provided with an oscillatory drive can be used, for instance, to cut or grind workpieces, the oscillatory motion of the tool making it possible, in principle, to achieve precise guidance with a high cutting and material removal rate.

It has been found that, during use of such hand power tools, vibrations can occur that a user may perceive as irritating in the case of prolonged use.

In this connection, for the purpose of vibration compensation, WO 2008/128804 A1 proposes a mass compensation device, which executes a compensatory motion counteracting the oscillatory motion generated by the oscillatory drive.

In principle, therefore, it is possible to reduce vibrations, but the mass compensation device necessitates a more elaborate structure and a considerable additional weight. In addition, the mass compensation device requires a whole series of parts that are movably coupled to one another and that have to be supplied with transmission grease in order to ensure that the machine runs smoothly. Since the oscillatory drive concerned is usually operated at high frequency, this results in flexing motions and grease stresses being produced, which can result in heating of the tool and which can have a detrimental effect upon the efficiency and service life of the machine concerned.

SUMMARY OF THE INVENTION

In view of this, it is a first object of the invention to disclose a power-driven hand tool for driving a tool in oscillation, which allows for high performance and reduced vibrations.

It is a second object of the invention to disclose a power-driven hand tool for driving a tool in oscillation allowing for high efficiency.

It is a third object of the invention to disclose a power-driven hand tool for driving a tool in oscillation allowing for low component stress.

In one aspect of the invention these object and other objects are achieved by a power-driven hand tool, comprising:

a tool spindle that can be driven in a rotational oscillatory manner about its longitudinal axis and that is configured for carrying a tool;

a transmission housing;

an eccentric coupling drive received within said transmission housing for driving said tool spindle and from which said tool spindle projects outwardly with one end; and a compensatory mass for compensating oscillations originating from the rotational oscillatory motion, said compensatory mass being disposed outside of said transmission housing within a chamber that is enclosed by a machine housing.

The object of the invention is thereby fully achieved.

Since the compensatory mass is disposed outside of the transmission housing, the transmission housing can be designed in a very compact manner. The lubricant chamber can be kept small, such that the grease requirement can be reduced to a minimum. Losses in the performance capability of the machine that occur as a result of flexing work caused by grease that is moved back and forth can be reduced considerably.

Throughout this application a compensatory mass is understood as a mass that is either an additional mass or a mass enlargement when compared to the design without the compensatory mass.

A very low-vibration running is thus achieved, combined with little heating of the machine and a high machine efficiency.

In a preferred development of the invention, the compensatory mass is located in a chamber that is enclosed by a machine housing and outside of the transmission housing.

This ensures that the machine is safe to touch and of an ergonomic design.

In a further preferred embodiment of the invention, the eccentric coupling drive comprises a motion reversal device, which converts an oscillatory drive motion, generated by the eccentric coupling drive, into an oscillatory drive motion of the tool spindle having an opposing direction of rotation.

In this case, the drive motion itself is used to bring about a vibration compensation, in which a portion of the components involved in transmitting drive is converted into a motion that counteracts the motion of the other portion of the components involved. It is thereby possible to effect, as it were, an at least partial extinction of the vibrations perceived by an operator, without the need for concomitantly running, elaborate additional devices that have mass.

According to a further design of the invention, the eccentric coupling drive comprises an eccentric lever, which is pivotally mounted at a first end and, at a second end, is driven via an eccentric.

In this case, the tool spindle is preferably driven by means of a rocker, which acts on the eccentric lever in a rotationally movable manner.

The oscillatory motion of the eccentric lever that is generated by the eccentric can thus easily be converted into an oscillatory drive motion of the tool spindle having an opposing direction of rotation.

According to a further design of the invention, the eccentric lever, at its first end, is connected in a rotationally fixed manner to an eccentric lever axle that is mounted in a swivellable manner in the transmission housing, the compensatory mass being carried, secured against torsion, at least at one end of the eccentric lever axle that projects out of the transmission housing.

The compensatory mass can thus easily be fixed outside of the transmission housing, in such a way that the compensatory mass is coupled to the eccentric lever in a rotationally fixed manner.

According to a further design of the invention, the eccentric lever carries a rotary bearing, which is acted upon by the rocker that is connected to the tool spindle in a rotationally fixed manner.

The oscillatory drive motion of the eccentric lever having a reversed direction of rotation can thus easily be transmitted to the tool spindle.

In this case, preferably, the rotary bearing is disposed between the tool spindle and the eccentric lever axle.

A space-saving construction can thus be achieved.

According to a further design of the invention, the rotary bearing comprises a bearing axle that is carried on the eccentric lever and on which there is carried a bearing, upon which the rocker acts.

A simple and reliable construction is thus ensured.

In a further design of the invention, the eccentric lever extends around the tool spindle, and an elongate hole, through which the tool spindle extends, is preferably provided on the eccentric lever.

It is thus possible to achieve a space-saving construction.

According to a further design of the invention, the eccentric coupling drive is driven by a motor, via a step-down transmission.

A high drive rotational speed of a standard universal motor can thus be stepped down. Depending on the particular application, instead of a step-down transmission, a step-up transmission for stepping up speed is also conceivable.

Also, or as an alternative to this, the eccentric coupling drive itself could also be realized for stepping up or stepping down.

Starting from a given motor rotational speed, it is thus possible for the oscillation frequency of the oscillatory drive to be optimally adapted to a particular application.

The transmission between the eccentric coupling drive and the motor in this case can comprise, for instance, a spur gear, which is driven by a driving pinion of the motor.

In a further preferred design of the invention, the compensatory mass is carried on a side of the eccentric coupling drive that faces away from the eccentric lever.

An optimum compensation of mass can thus be achieved.

In a further preferred design of the invention, the compensatory mass is dimensioned such that the centre of gravity of the movable parts of the eccentric coupling drive, including the compensatory mass, coincides approximately with a longitudinal axis of an eccentric lever axle, about which the eccentric lever can be swivelled.

For rotationally symmetrical tools, it is thus possible to achieve an optimum compensation of mass and an optimum reduction of vibration.

It is understood that the above-mentioned features of the invention and those yet to be explained in the following can be applied, not only in the respectively specified combination, but also in other combinations or singly, without departure from the scope of the invention.

BRIEF DESCRIPTION OF THE DRAWINGS

Further features and advantages of the invention are given by the following description of a preferred exemplary embodiment, with reference to the drawing, wherein.

DESCRIPTION OF PREFERRED EMBODIMENTS

Figure 1:
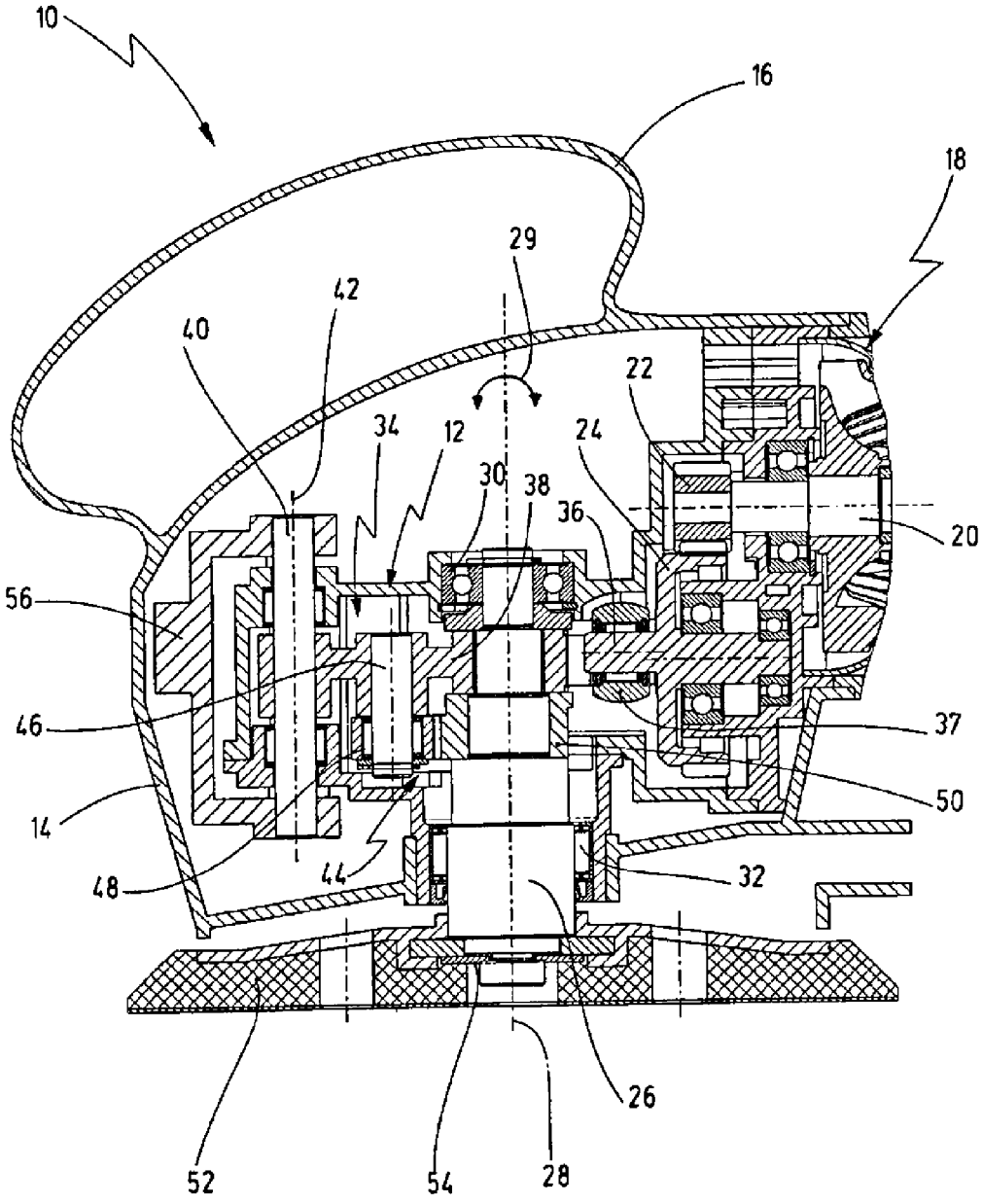
FIG. 1 shows a section through a hand tool according to the invention, in the region of the top of its transmission.
Figure 2:
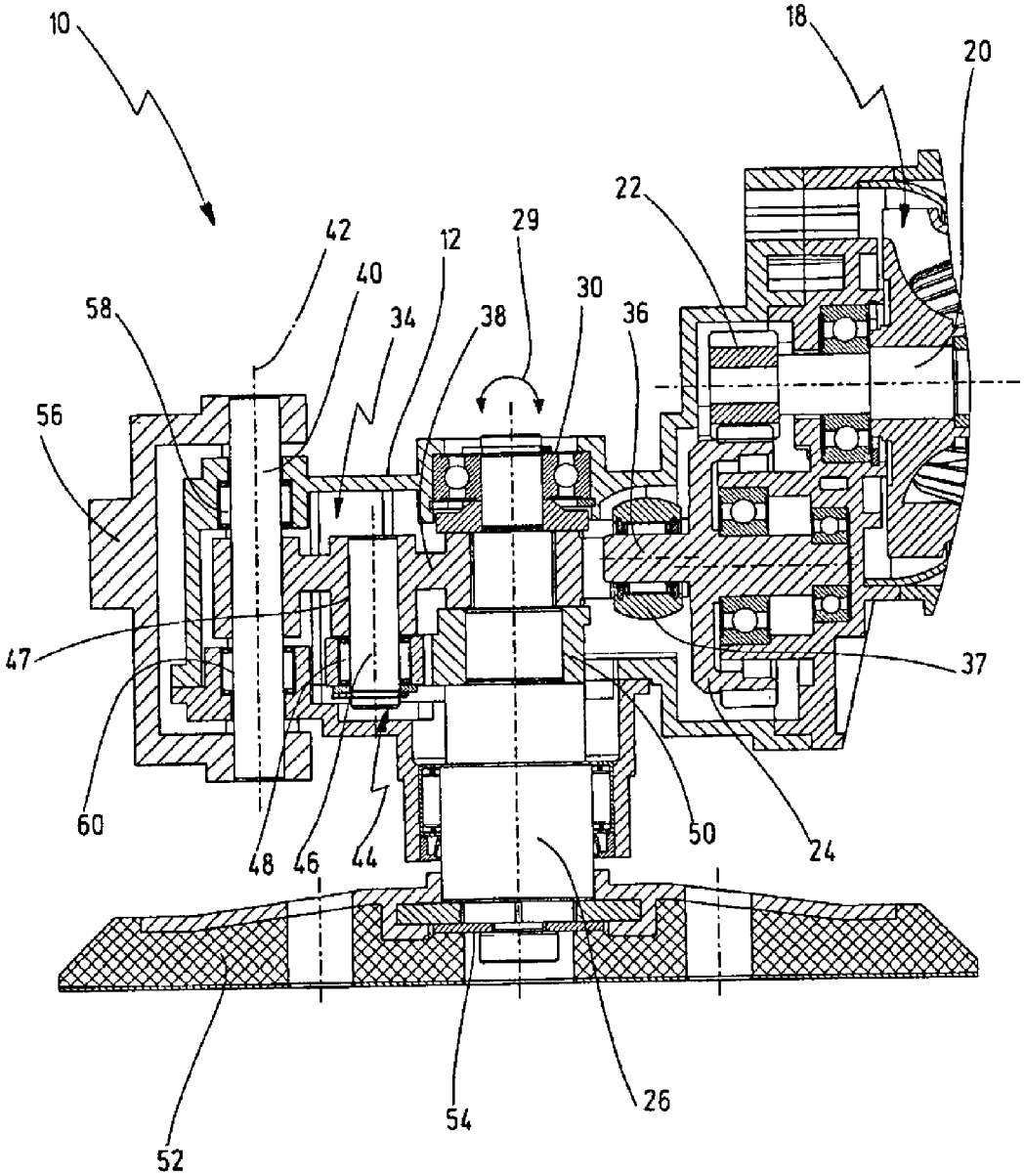
FIG. 2 shows an enlarged section according to FIG. 1, but with the machine housing not being represented.
Figure 3:
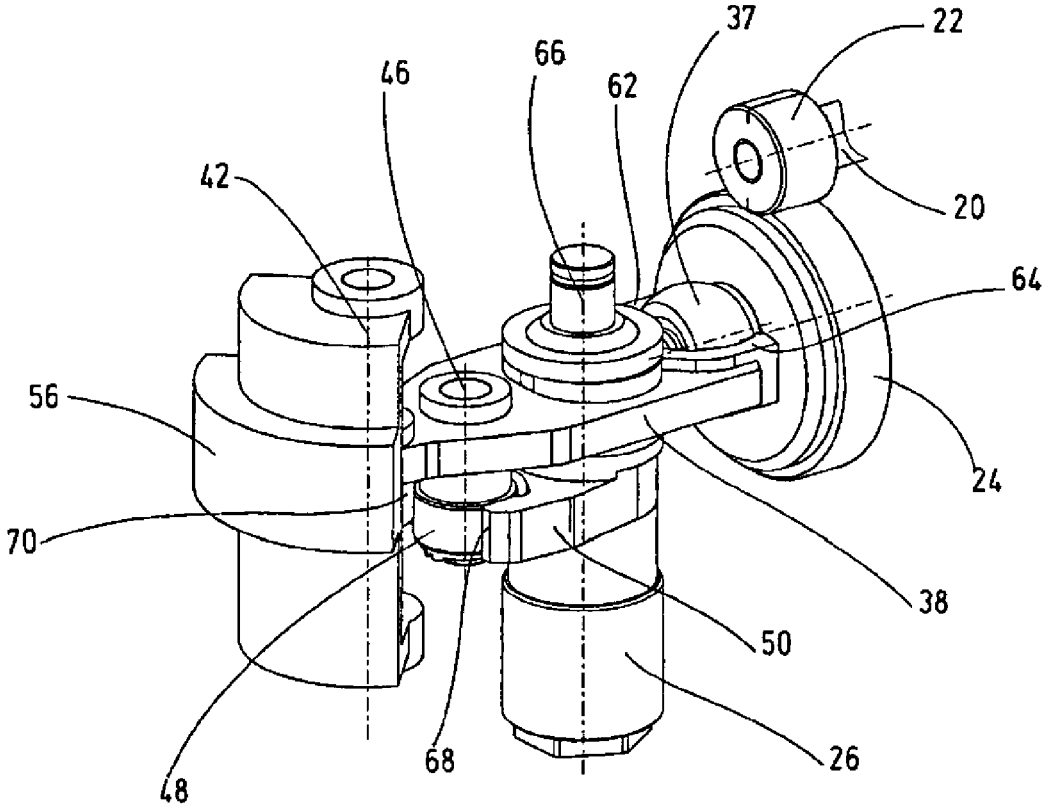
FIG. 3 shows a perspective view of the eccentric coupling drive, including a compensatory mass and spur gear drive, but with the remaining parts not being represented.
Figure 4:
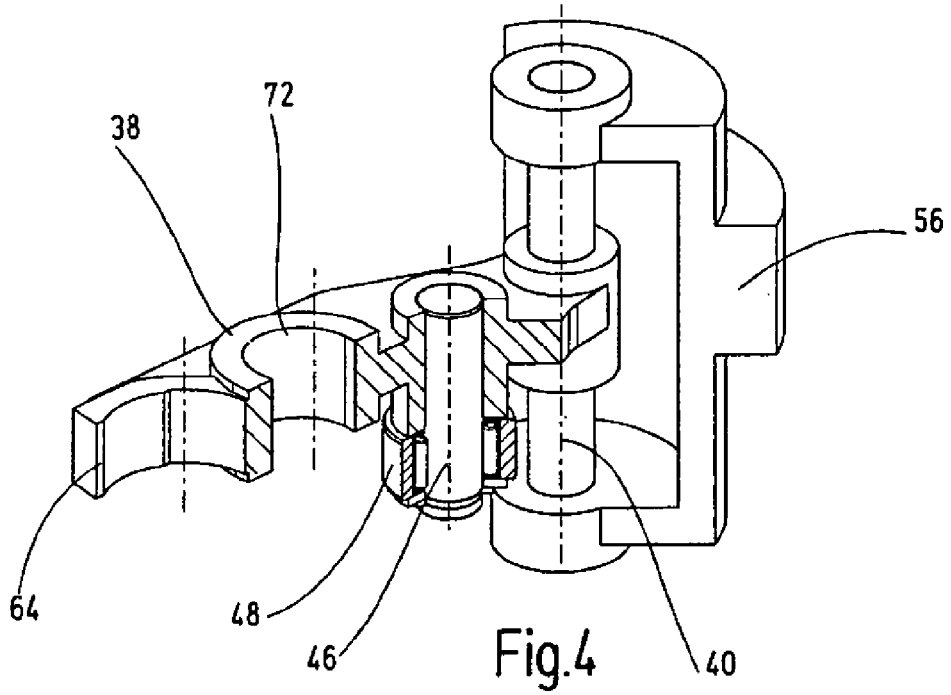
FIG. 4 shows a partially sectional, perspective view of the eccentric lever, including a compensatory mass.

In FIGS. 1 and 2, a power-driven hand tool according to the invention is represented in the region of the top of its transmission, and denoted as a whole by the reference numeral 10.

The hand tool 10 is an oscillatory drive tool, which is used, in particular, for grinding or cutting.

The hand tool 10 has a machine housing 14, provided within which there is a transmission housing 12, in which there is mounted a tool spindle 26 that, with one of its ends, projects outwardly out of the transmission housing 12 and out of the machine housing 14.

The tool spindle 26 is mounted by means of two bearings 30, 32 and, at its outer end, has a receiver 54, on which a tool 52, in this case a grinding tool, is fastened in a detachable manner.

Indicated at the upper end of the machine housing 14, on a side that faces away from the tool 52, there is a handle 16, by which the hand tool 10 can be held during a work operation.

Carried inside the transmission housing 12 there is an eccentric coupling drive, denoted as a whole by 34, which converts the rotating drive motion of a motor 18 into a rotationally oscillating drive motion of the tool spindle 26 about its longitudinal axis 28.

The eccentric coupling drive 34 puts the tool spindle 26 into an oscillatory drive motion having a high frequency, for instance 5000 to 30 000 oscillations per minute, and having a small pivot angle, for instance 0.5° to 7°. This rotational oscillatory motion is indicated by a double arrow denoted by 29.

The rotating drive motion of the motor shaft 20 of the motor 18 is firstly stepped down via a spur gear transmission, consisting of a driving pinion 22 at the end of the motor shaft 20, and of a spur gear 24.

The spur gear 24 drives an eccentric 36, which converts the rotatory drive motion of the spur gear 24 into an oscillatory motion of an eccentric lever 38, which, at its opposite end, is mounted in a swivellable manner by means of an eccentric lever axle 40.

Carried on the eccentric lever 38 there is a rotary bearing, consisting of a bearing axle 46 and a bearing 48, which rotary bearing drives a rocker 50 that is connected to the tool spindle 26 in a rotationally fixed manner.

By means of a motion reversal device 44, consisting of a bearing axle 46, bearing 48 and rocker 50, the oscillatory drive motion of the eccentric lever 38 is thus converted into an oscillatory drive motion of the tool spindle 26 having a direction of rotation opposite to that of the drive motion of the eccentric lever 38. This reversal of the direction of rotation results in a perceptible reduction of the vibrations emanating from the eccentric coupling drive 34.

Additionally provided according to the invention is a compensatory mass 56, which, at the two ends of the eccentric lever axle 40 that project out of the transmission housing 12, are connected in a rotationally fixed manner to the eccentric lever axle 40, which, in turn, is connected to the eccentric lever 38 in a rotationally fixed manner.

Further, the compensatory mass 56 is dimensioned such that the centre of gravity of the movable parts of the eccentric coupling drive 34, including the compensatory mass 56, coincides approximately with the longitudinal axis 42 of the eccentric lever axle 40.

A particularly effective vibration reduction can thus be achieved.

According to the invention, the compensatory mass 56 is carried outside of the transmission housing 12, inside the chamber enclosed by the machine housing 40. This arrangement enables the transmission housing 12 to be realized in a very compact manner, and requires only very little space to be filled with grease. In this way, the structural size of the transmission housing 12 is kept very small, the volume of the grease filling that is required is reduced to a minimum and, at the same time, the flexing work of the grease during operation is reduced considerably, thereby counteracting heating and, at the same time, ensuring high efficiency.

The compensatory mass 56 can thus be optimally dimensioned, in order to achieve an effective vibration reduction without the structural size of the transmission housing 12 being increased as a result.

The structure and functioning of the transmission are explained more fully below with reference to FIGS. 2 to 6.

An eccentric bearing 37 having a convex outer ring is carried on the eccentric 36 that is driven by the spur gear 24. The eccentric lever 38 acts, with a fork-shaped end having two sliding surfaces 62, 64 (cf., in particular, FIGS. 3, 5), on the outer ring of the eccentric bearing 37.

Figure 5:
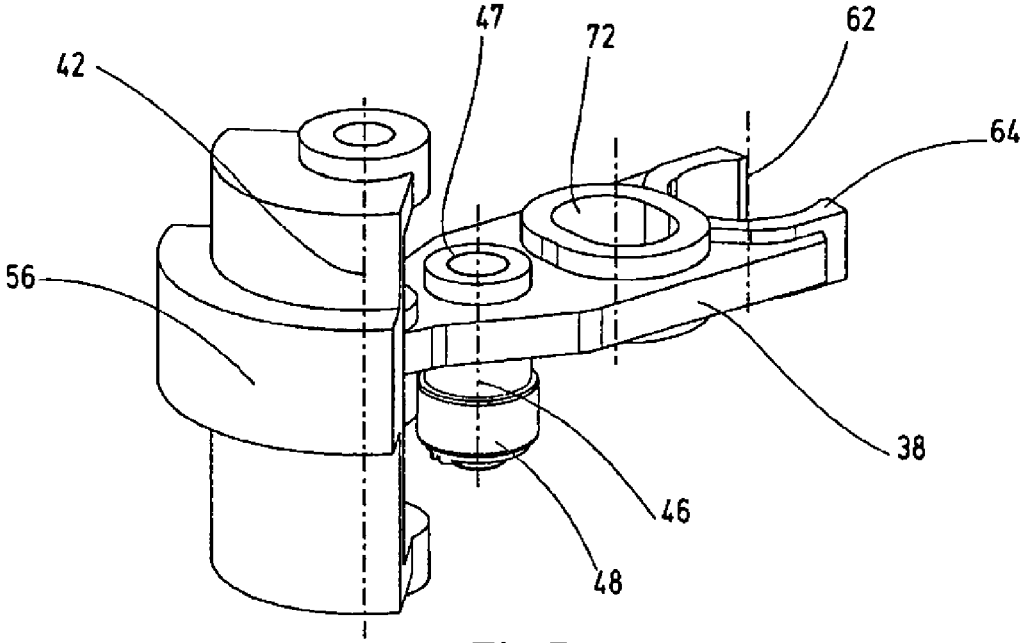
FIG. 5 shows a perspective view of the eccentric lever, including a compensatory weight, and a bearing axle, including a bearing, carried on the eccentric lever.
Figure 6:
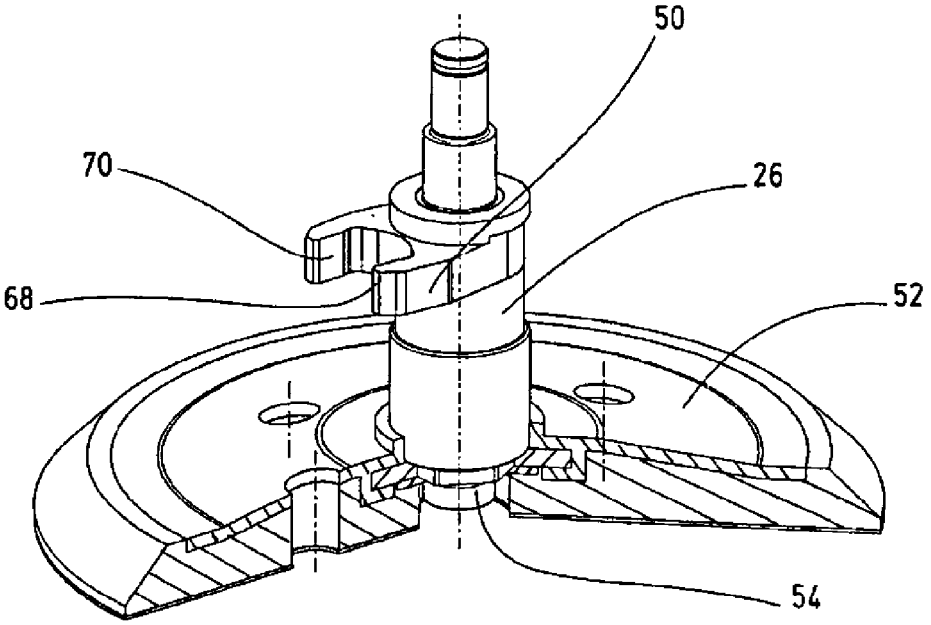
FIG. 6 shows a partially sectional, perspective view of the tool, which is fastened to the outer end of the tool spindle, including a representation of the rocker carried on the tool spindle.

According to FIG. 5, the eccentric lever 38 has an elongate hole 72, through which the tool spindle 26 extends, such that the oscillatory motion of the eccentric lever 38 does not interfere with the tool spindle 26.

The eccentric lever 38, at its end that is opposite the eccentric 36, is pressed together with the eccentric lever axle 40, and is thus connected to the latter so as to be secured against torsion. For the purpose of mounting the eccentric lever 38, two needle bearings 58, 60 are provided, in which the eccentric lever axle 40 is mounted in a swivellable manner.

Approximately centrally between the eccentric lever axle 40 and the elongate hole 72, the bearing axle 46 is pressed into a correspondingly shaped recess 47 of the eccentric lever 38. The bearing axle 46 projects out of the eccentric lever 38 in the direction of the tool 52, and carries a needle bearing 48 at its outer end.

The rocker 50 is fastened, e.g. pressed on, so as to be secured against torsion on the tool spindle 26 (cf. FIG. 6), and comprises the needle bearing 48 having a fork-shaped end, on which two sliding surfaces 68, 70 are provided.

The oscillatory drive motion of the eccentric drive 38 that is generated by the eccentric 36 is thus converted into an oscillatory drive motion of the tool spindle 26 in the opposing direction.

What is claimed is:

1. A power-driven hand tool, comprising:

a tool spindle that can be driven in a rotational oscillatory manner about its longitudinal axis and that is configured for carrying a tool;

a transmission housing;

an eccentric coupling drive received within said transmission housing for driving said tool spindle and from which said tool spindle projects outwardly with one end; and a compensatory mass for compensating oscillations originating from the rotational oscillatory motion of said tool spindle, said compensatory mass being disposed outside of said transmission housing within a chamber that is enclosed by a machine housing;

wherein said eccentric coupling drive comprises a motion reversal mechanism which converts an oscillatory drive motion, generated by the eccentric coupling drive into an oscillatory drive motion of said tool spindle having an opposing direction of rotation;

wherein said eccentric coupling drive comprises an eccentric lever which is pivotally mounted at a first end and, at a second end, is driven via an eccentric; and wherein said compensatory mass is carried on a side of said eccentric coupling drive that faces away from said eccentric lever.

2. The hand tool of claim 1, wherein said tool spindle is driven by means of a rocker which engages said eccentric lever in a rotationally movable manner.

3. The hand tool of claim 1, wherein said eccentric lever at a first end thereof, is connected in a rotationally fixed manner to an eccentric lever axle that is mounted in a swivellable manner in said transmission housing, said compensatory mass being carried, secured against torsion, at least at one end of said eccentric lever axle that projects out of said transmission housing.

4. The hand tool of claim 2, wherein said eccentric lever carries a rotary bearing, which is acted upon by said rocker that is connected to said tool spindle in a rotationally fixed manner.

5. The hand tool of claim 4, wherein said rotary bearing is disposed between said tool spindle and said eccentric lever axle.

6. The hand tool of claim 1, wherein said eccentric coupling drive comprises an eccentric lever axle having a longitudinal axis about which said eccentric lever can be swivelled; and said compensatory mass is dimensioned so that a centre of gravity of any movable parts of said eccentric coupling drive including said compensatory mass coincides substantially with said longitudinal axis of said eccentric lever axle.

7. A power-driven hand tool, comprising:

a tool spindle that can be driven in a rotational oscillatory manner about its longitudinal axis and that is configured for carrying a tool;

a transmission housing;

an eccentric coupling drive received within said transmission housing for driving said tool spindle and from which said tool spindle projects outwardly with one end; a compensatory mass for compensating oscillations originating from the rotational oscillatory motion, said compensatory mass being disposed outside of said transmission housing within a chamber that is enclosed by a machine housing wherein said eccentric coupling drive comprises an eccentric lever which is pivotally mounted at a first end and, at a second end, is driven via an eccentric; and wherein said eccentric lever at its first end, is connected in a rotationally fixed manner to an eccentric lever axle that is mounted in a swivellable manner in said transmission housing, said compensatory mass being carried, secured against torsion, at least at one end of said eccentric lever axle projecting out of said transmission housing.

8. The hand tool of claim 7, wherein said eccentric coupling drive comprises a motion reversal device which converts an oscillatory drive motion, generated by the eccentric coupling drive into an oscillatory drive motion of the tool spindle having an opposing direction of rotation.

9. The hand tool of claim 7, wherein said tool spindle is driven by means of a rocker engaging said eccentric lever in a rotationally movable manner.

10. The hand tool of claim 9, wherein said eccentric lever carries a rotary bearing, which is acted upon by said rocker that is connected to said tool spindle in a rotationally fixed manner.

11. The hand tool of claim 10, wherein said rotary bearing is disposed between said tool spindle and said eccentric lever axle.

12. The hand tool of claim 10, wherein said rotary bearing comprises a bearing axle that is carried on said eccentric lever and on which there is carried a bearing upon which said rocker acts.

13. The hand tool of claim 7, wherein said eccentric lever extends around said tool spindle.

14. The hand tool of claim 7, wherein an elongate hole through which the tool spindle extends, is provided on said eccentric lever.

15. The hand tool of claim 7, wherein said eccentric coupling drive is driven by a motor via a transmission comprising a spur gear which is driven by a driving pinion of said motor.

16. The hand tool of claim 7, wherein said compensatory mass is carried on a side of the eccentric coupling drive that faces away from said eccentric lever.

17. The hand tool of claim 7, wherein said compensatory mass is dimensioned such that a centre of gravity of any movable parts of said eccentric coupling drive including said compensatory mass coincides substantially with a longitudinal axis of an eccentric lever axle about which said eccentric lever can be swivelled.

18. A power-driven hand tool, comprising:

a tool spindle that can be driven in a rotational oscillatory manner about its longitudinal axis and that is configured for carrying a tool;

a transmission housing;

an eccentric coupling drive received within said transmission housing for driving said tool spindle and from which said tool spindle projects outwardly with one end; and a compensatory mass for compensating rotary oscillations originating from the rotational oscillatory motion, said compensatory mass being disposed outside of said transmission housing within a chamber that is enclosed by a machine housing;

wherein said eccentric coupling drive comprises an eccentric lever which is pivotally mounted at a first end and, at a second end, is driven via an eccentric;

wherein said compensatory mass is carried on a side of said eccentric coupling drive that faces away from said eccentric lever; and wherein said compensatory mass is dimensioned so that a centre of gravity of any movable parts of said eccentric coupling drive including said compensatory mass coincides substantially with a longitudinal axis of an eccentric lever axle about which said eccentric lever can be swivelled.

* * * * *